United States Patent [19]

Blom

[11] Patent Number: 4,584,917

[45] Date of Patent: Apr. 29, 1986

[54] AUTOMATIC BLADE DIAMETER COMPENSATION FOR LOG SAWS

[75] Inventor: Lawrence E. Blom, Pulaski, Wis.

[73] Assignee: Paper Converting Machine Company, Green Bay, Wis.

[21] Appl. No.: 678,771

[22] Filed: Dec. 6, 1984

[51] Int. Cl.[4] ..... B26D 7/12

[52] U.S. Cl. ..... 83/174; 83/329; 51/165.87; 51/247

[58] Field of Search ..... 83/174, 14, 13, 37, 83/329; 51/165.87

[56] References Cited

U.S. PATENT DOCUMENTS 2,879,633 3/1954 Gage ..... 51/247

4,041,813 8/1977 Spencer ..... 83/174

*Primary Examiner*—Donald R. Schran

*Attorney, Agent, or Firm*—Tilton, Fallon, Lungmus & Chestnut

[57] ABSTRACT

An apparatus for transversely cutting logs of web material which are sequentially advanced along a first path and a rotating disc blade is mounted in said apparatus for movement in a second path through said first path from one side of the other of the first path to transversely sever said logs, a sharpener is provided in said apparatus for sharpening said blade. The apparatus is provided with structure for incrementally changing the relationship of said sharpener and said blade to compensate for diameter reduction of said disc blade. The apparatus is equipped with structure for altering the relationship of said paths to also compensate for diameter reduction of said blade.

4 Claims, 9 Drawing Figures

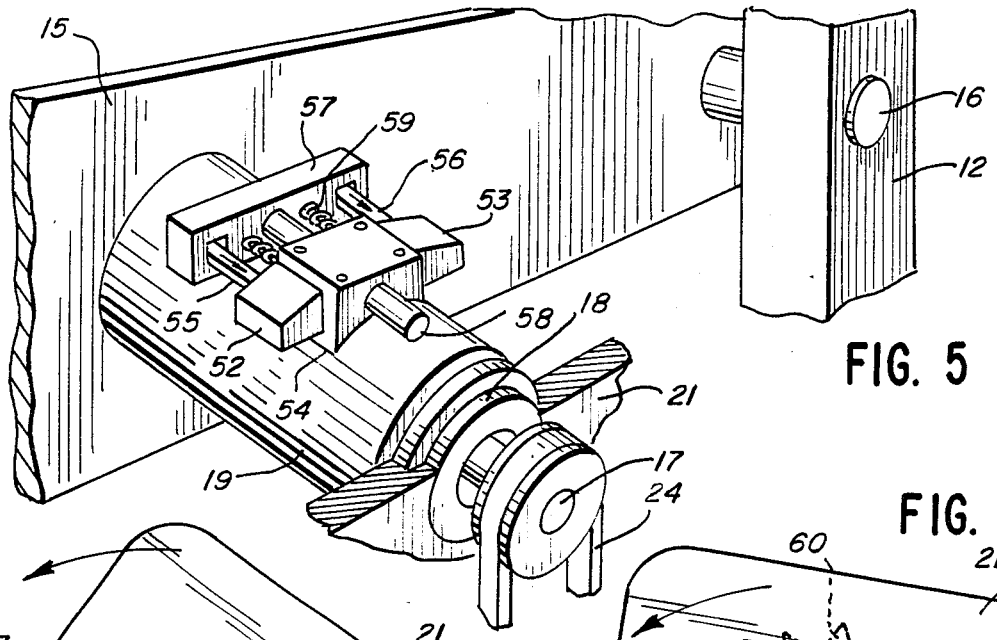
FIG. 5
FIG. 6
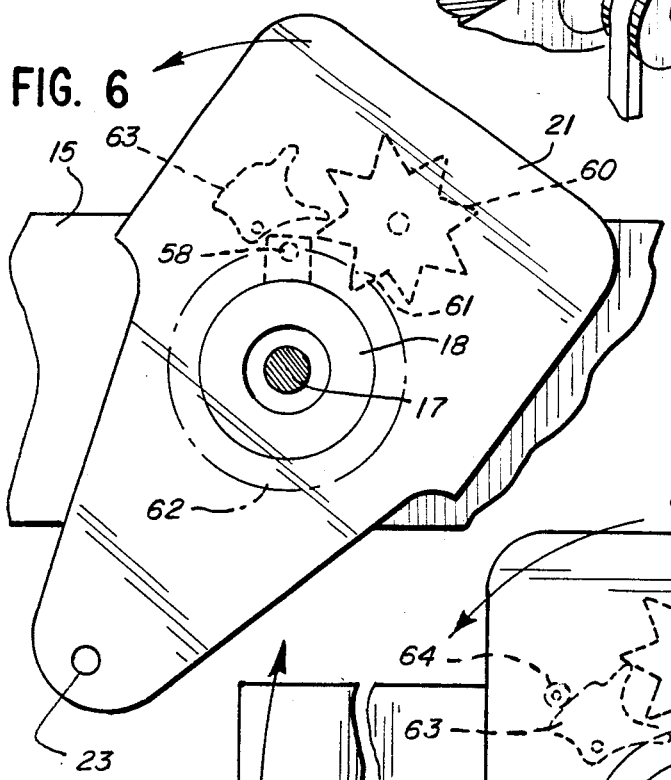
FIG. 7
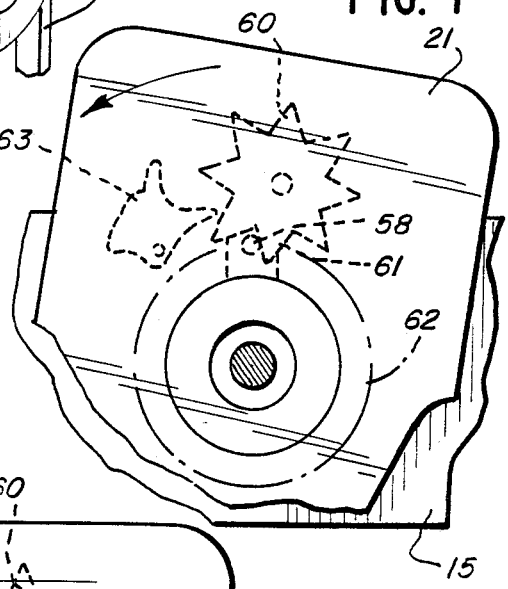
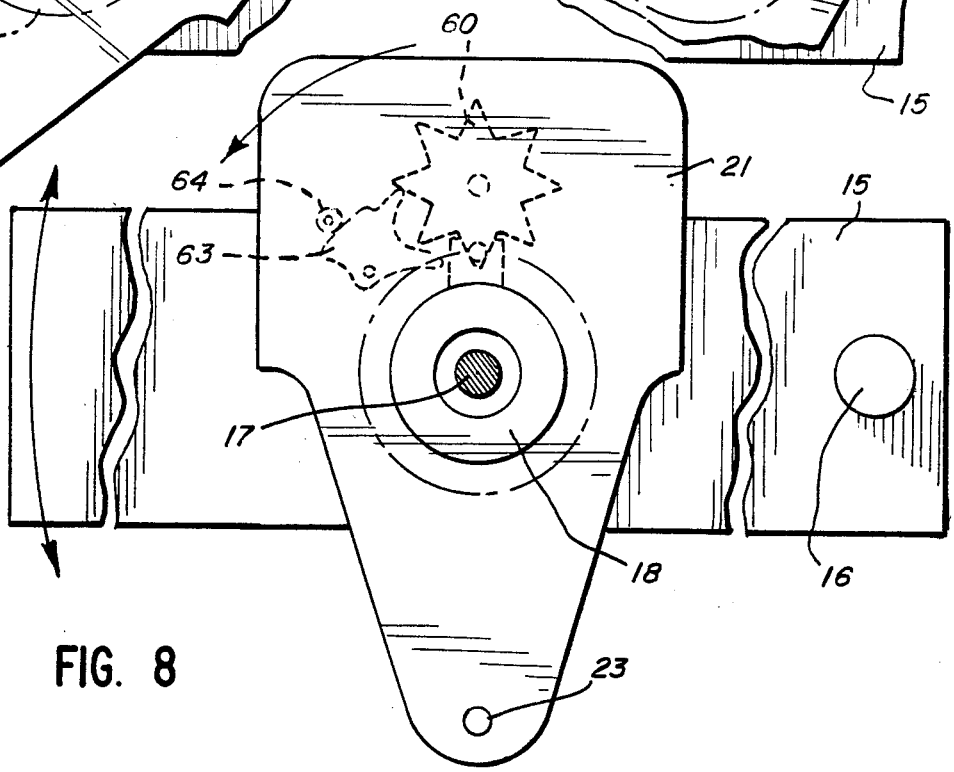
FIG. 8

AUTOMATIC BLADE DIAMETER COMPENSATION FOR LOG SAWS

This invention relates to automatic blade diameter compensation for log saws, and more particularly, to apparatus which automatically compensates for reduction in blade diameter while maintaining the blade in a sharpened condition.

BACKGROUND

In the sanitary paper converting industry, wide webs of lightweight tissue or toweling stock are rewound from large mill rolls into wide logs of about 4" to 6" diameter, which are then cut into individual consumer size rolls for subsequent packaging. Saws used for this cutting operation are well known and have single rotating blades mounted on pivoting or rotating arm assemblies as described in U.S. Pat. Nos. 2,752,999, 2,766,566, 3,213,731, 3,282,470, or can have two rotating blades as described in U.S. Pat. No. 4,041,813. A typical grinding assembly to keep the cutting blades sharp is described in '813 and in U.S. Pat. No. 4,347,771. Both patents are directed toward grinding stones which are not driven, but which rotate on urging contact with a driven rotating blade, however, either idling or driven grinder stones can be applied to the structure and concept of this invention.

Because of the abrasive nature of wood fibers and the density of the rewound logs, driven rotating blades must be sharpened frequently (for example every 5 to 15 seconds) to keep the blade edge honed, prevent bias cutting of the rolls, and maintain clean and square end cuts. Sharpening devices, including the grinding stones, stone drive system (if used), and associated actuating mechanisms, can be mounted differently. For example, the grinding "assembly" can be rigidly attached to a fixed frame and held in close proximity to the blade edge. When the pivoting or orbiting motion of the blade(s) is stopped, an actuating mechanism moves the grinding stones into contact with, and grinding operation for, the blades which are still rotatably driven, but which are temporarily stopped from orbiting motion. It will be recognized that when the blade orbit is stopped, cutting of logs cannot take place, and such stoppage for grinding represents lost production time.

Known prior art also involves saws where the grinding mechanisms are mounted in close proximity to and orbit with (or pivot with) the blades so that grinding can occur while the blade orbiting motion and cutting continues—this resulting in higher production since the saw blades continue in orbit while grinding occurs. It will be recognized that as blades are ground and honed, the diameter decreases. In prior art saws, periodic adjustments must be initiated to move the grinding assembly toward the center of blade rotation and, since the decreased blade diameter decreases the radius of the orbit, a further adjustment must be made to move the axis of orbiting motion such that the now decreased blade diameter (and the decreased orbit radius) are adjusted a like amount to ensure that the blade will still cut all the way through the log which is normally conveyed through the saw at a fixed elevation.

SUMMARY OF THE INVENTION

Since cutting blade diameter decreases rapidly and necessitates various adjustments to keep grinder stones in contact with the blade when grinders are actuated, the operators of these machines must be alert to observe cut rolls and see the need for adjustment—often at the expense of product quality. Alternately, operators must initiate the adjustments at regular intervals to prevent subquality cuts—often at the expense of blade life. With prior art devices, and despite the fact that grinding frequency and duration can be electrically timed to keep the blade sharp, the above mentioned adjustments are needed to compensate for blade wear and, therefore, require constant operator attention.

This invention is directed toward a device and system which eliminates the need for operator attention and automatically adjusts the grinder position relative to the blade and blade position relative to the log to compensate for decreased blade diameter due to grinding while the saw is operating and cutting. More particularly, the invention provides apparatus for adjusting selectively the orbit of the blade in response to a signal which initiates incremental movement of a pivotal plate carrying the rotating, orbiting blade. Additionally, a signal is employed to selectively and incrementally position the sharpening means, usually grinding stones, in a relationship to the blade so as to compensate for either or both of blade diameter decrease and blade repositioning.

Other objects and advantages of the invention may be seen in the details of the ensuing specification.

The invention is described in conjunction with an illustrative embodiment in the accompanying drawing, in which FIG. 1 is a perspective view of apparatus embodying the teachings of the invention as would be viewed from the discharge end of paper log sawing apparatus;

FIG. 5 is a fragmentary perspective view of the mechanism employed for blade grinder vertical adjustment;

FIG. 6 is a fragmentary end elevational view taken from the entering end and showing additional components associated with the grinder vertical adjustment;

FIGS. 7 and 8 are views similar to FIG. 6 but showing the mechanism in different operating positions.

DETAILED DESCRIPTION

Figure 1:
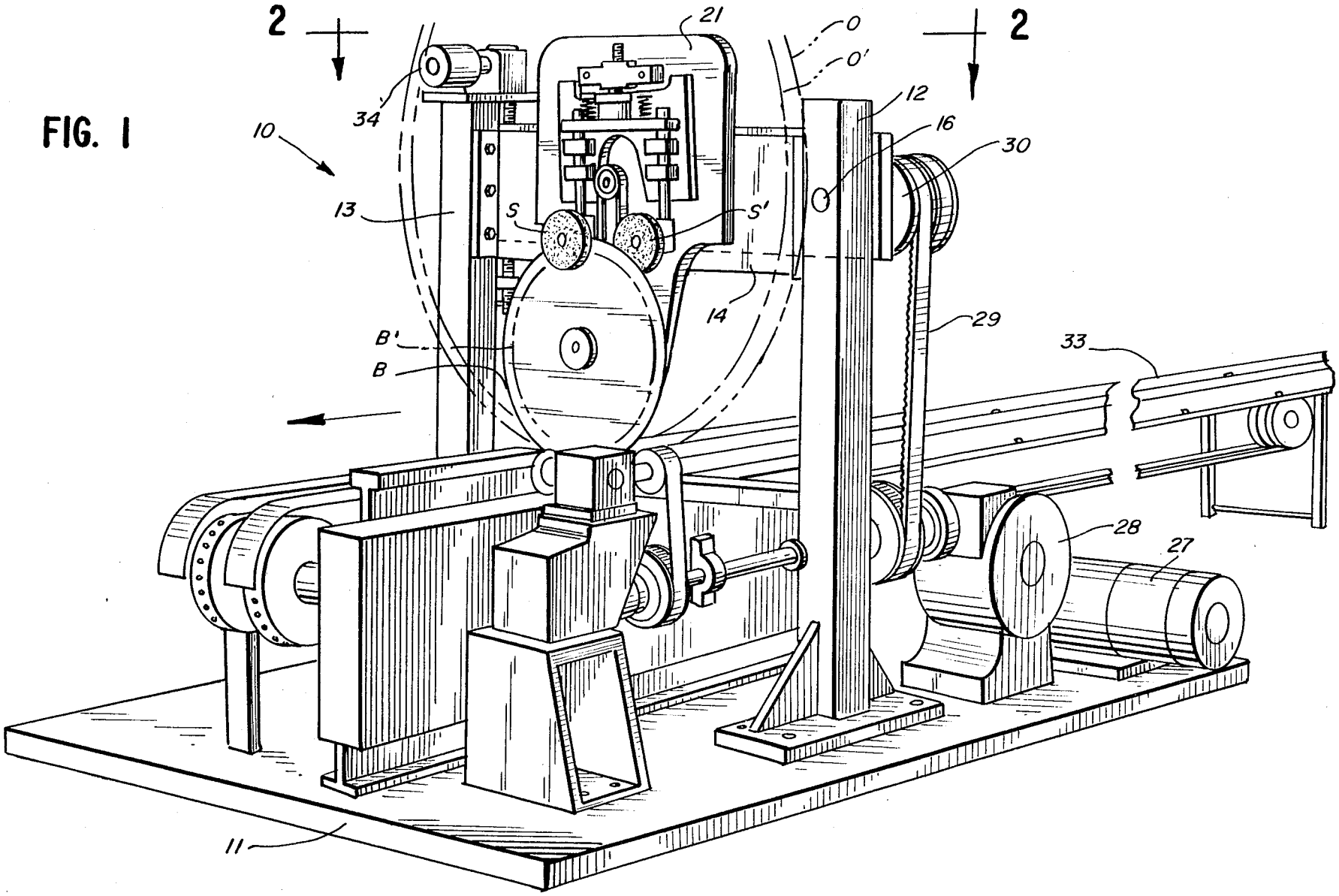

In the illustration given and with reference first to FIG. 1, the numeral 10 designates generally log sawing apparatus of the type previously described, i.e., apparatus for handling elongated rolls of convolutely wound paper such as is conventionally used in toilet tissue and kitchen toweling. Such apparatus is conventionally employed in conjunction with a rewinder where jumbo rolls or paper from a paper machine are rewound into retail size rolls. Such elongated rolls or logs normally would be delivered to the entering end of the apparatus 10, i.e., at the extreme right.

The apparatus 10 includes a base plate or other frame providing means which rigidly support upstanding columns 12 and 13. The columns 12, 13 are transversely connected a spaced distance above the base plate 11 by means of a rigid beam 14—forming, in effect, an inverted U-shaped framework.

Also extending transversely across the machine and parallel to the beam 14 is a plate 15 which is pivotally mounted on the column 12 as at 16. The plate 15 is upstream of the beam 14 as can be readily appreciated from a consideration of FIG. 2 where these two elements are seen in horizontal section and designated at the extreme bottom thereof. The plate 15 can also be seen in FIGS. 3–6 and 8 and the pivotal mounting 16 seen in the left hand upper portion of FIG. 3 and the right hand portion of FIGS. 5 and 8. As will be explained in detail hereinafter, the blade B (see FIG. 1) can be raised and lowered by virtue of pivoting the plate 15 about the pivot 16. For example, the blade B is moved through an orbit O (still referring to FIG. 1) but after wear, the disc blade diameter may be that of B' and now moving in reduced orbit O' would not sever logs completely until the orbit is adjusted so that the nadir or O' is the same as the nadir of orbit O.

However, before going into the compensating mechanism of the invention, a general explanation of the operation of the log sawing apparatus will be given.

Operation Generally

Figure 2:
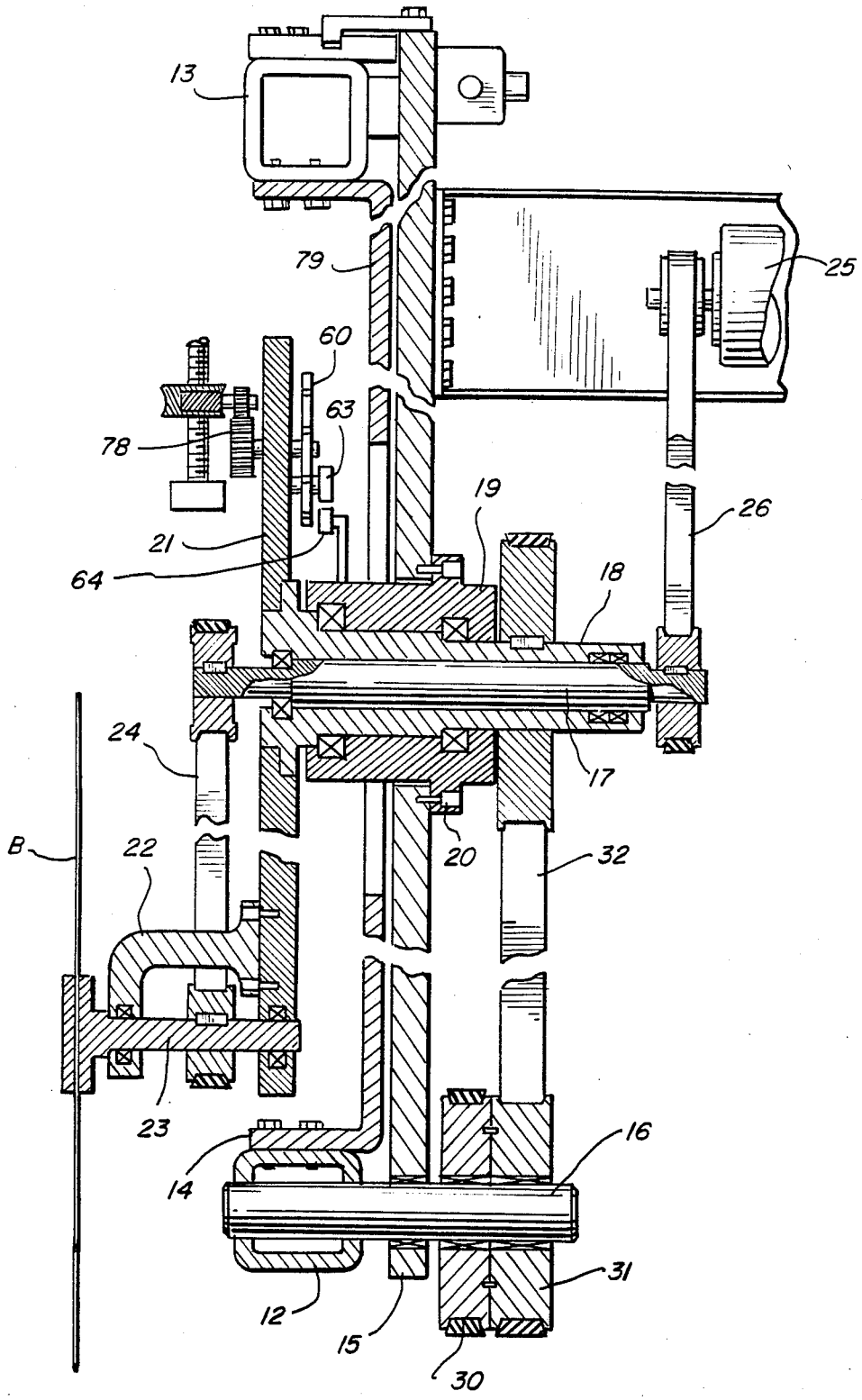
FIG. 2 is a transverse sectional view taken along the sight line 2—2 of FIG. 1.

The blade B is seen in the lower left hand portion of FIG. 2. It is mounted for both rotation and orbiting as previously indicated. The rotation is achieved through a rotating shaft 17—see the central right hand portion of FIG. 2 and the orbiting is achieved through a hollow shaft 18 which encircles the shaft 17. The shaft 17 is suitably journalled by means of bearings in conventional fashion within the hollow shaft 18 and the hollow shaft 18, in turn, is journalled by suitable bearings within a fixed hub 19 rigidly secured as at 20 to the pivotal plate 15. Thus, as the plate 15 is pivoted, the rotation and orbit producing means are likewise moved.

At the downstream end of the hollow shaft 18, i.e., at the left hand side of FIG. 2, an arm 21 is rigidly fixed thereto. The arm 21 can also be seen in the upper central portion of FIGS. 1, 3 and 6–9. The arm 21 (referring again to the lower left hand portion of FIG. 2) carries a bracket 22 which, along with the arm 21 itself rotatably supports a shaft 23 carrying the blade B. Still referring to the lower left hand portion of FIG. 2, a belt and pulley system 24 connects the shaft 17 to the shaft 23 so as to provide rotational power for the blade B. Power for rotating the blade B is derived from a motor 25 seen in the upper right hand portion of FIG. 2 and connected to the shaft 17 by means of a belt and pulley system 26. Power to rotate the arm 21 and thus orbit the blade B is derived from another motor 27 which is seen in the extreme lower right hand portion of FIG. 1. Rotational power is delivered to a speed reducer 28 and a belt and pulley system 29 (still referring to FIG. 1) to a pulley 30 which is rotatably mounted on the pivot shaft 16—see the extreme lower right hand portion of FIG. 2. The pulley 30 is fixed to a second pulley 31 which is part of a pulley and belt system 32 which drives the hollow shaft 18 and hence rotates the arm 21.

Normally, logs are advanced through an infeed conveyor 33—see the right hand portion of FIG. 1 in incremental fashion, viz., the conveyor indexing forwardly about 4½" for tissue or from 9" to 11" for toweling, stopping while the log is being cut. The cutting is achieved by the blade B traveling through an orbit O having its nadir below the bottom of the logs being cut. To maintain this desired relationship between the orbit nadir and the log path, the orbit must be lowered in the illustration given in order to compensate for decrease in blade diameter.

Blade Nadir Adjustment

Figure 3:
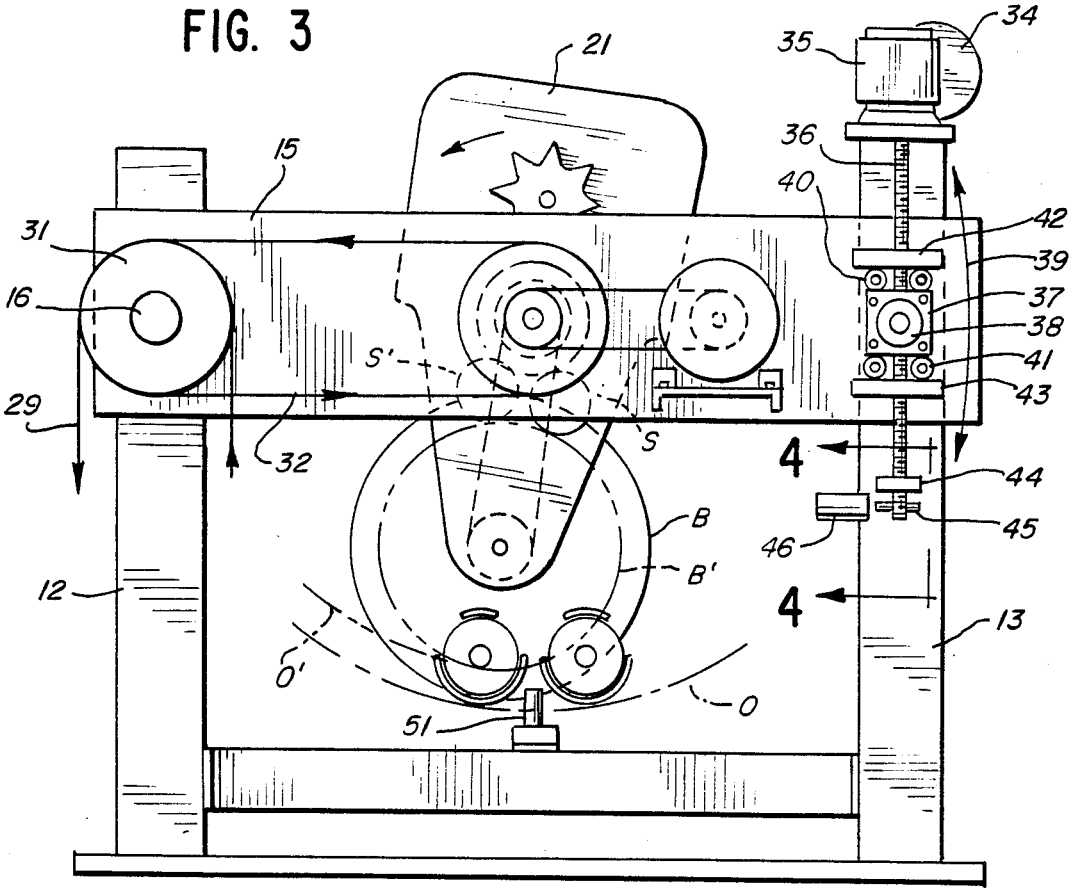
FIG. 3 is an end elevational view taken from the entering end of the apparatus and featuring the mechanism employed to raise and lower the blade orbit.
Figure 4:
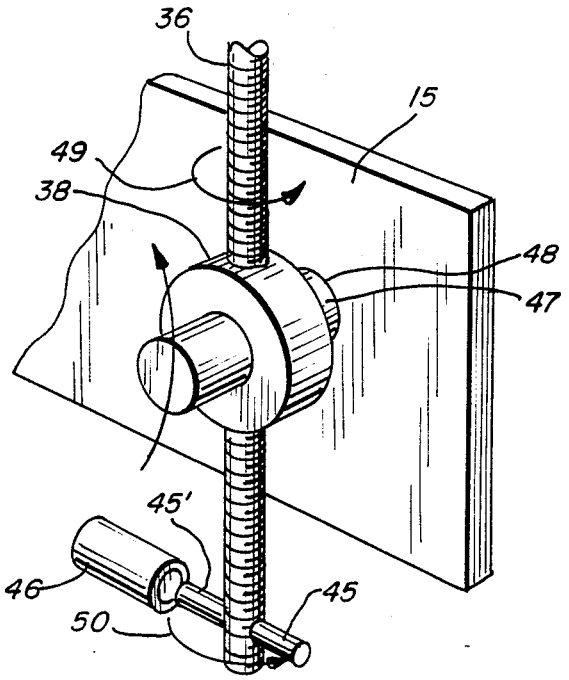
FIG. 4 is a fragmentary enlarged perspective view of the right hand portion of FIG. 3.

Reference is now made to the second drawing sheet which includes FIGS. 3 and 4, and particularly to the mechanism shown at the upper central right hand portion.

Referring now to FIG. 3 which is a view from the upstream side of the apparatus, viz., opposite to that seen generally in FIG. 1, the numeral 34 designates a motor seen in the extreme upper right hand portion of FIG. 3. The motor 34 is mounted atop the column 13 and can be seen in the upper left hand portion of FIG. 1 as well. The motor 34 provides rotational input to a right angle gear box 35 (now referring to the upper right hand portion of FIG. 3) so as to rotate a vertically extending screw lead 36. The screw lead extends through a clearance hole in a block 37 and through a threaded bore in the rotary translator 38 housed therewithin. Since plate 15 pivots in an arc as at 39, block 37 must be capable of horizontal translation since the radius from the vertical centerline of screw lead 36 changes as adjustments are made, hence, block 37 is contained between pairs of cam rollers 40 and 41 which are held between ways 42 and 43 bolted to pivoting cross plate 15.

Screw lead 36 is supported by internally threaded bracket 44 near the bottom thereof. Pin 45 is mounted at the bottom of screw lead 36 and extends on both sides an equal distance. It cooperatively functions with proximity switch 46. In FIG. 4, and extended journal 47 of rotary translator 38 fits into bore 48 of pivot plate 15 and causes movement and adjustment of the orbit. Relative to the log, however, repositioning the log conveyor is an equal but less desirable option.

As screw lead 36 is rotated in the direction of arrow 49, pin 45 also rotates in the direction of arrow 50 and continues to do so until pin portion 45 rotates 180° and is in position 45', at which time switch 46 senses its proximity and de-energizes motor drive 34.

In FIG. 3, when blade B is reduced to diameter B' due to grinding, grinder stones S and S' (see FIG. 1) are no longer in contact with the blade and, hence, must be adjusted downwardly. Also, the orbit of the outer blade edge is reduced to O' and no longer cuts all the way through the log, hence, the pivot beam and cutting head assembly, including blade, must be lowered to the original orbit O. Downward adjustment of the plate 15 starts with a signal that energizes motor 34 and stops when pin 45 lines up with the proximity switch 46.

FIG. 3 also shows a sensor switch 51 which will initiate the signal for automatic operation. Switch 51 is "U" shaped with a slot in the center. As the blade B passes through the slot, switch 51 instantaneously senses the presence of metal. Through a programmable controller, detection of metal during approximately 70% to 80% of the orbits indicate that no adjustments must be made. When the blade is worn down and the presence of metal is not sensed by switch 51 for ten consecutive orbits, the controller initiates the signal which concurrently energizes motor 34 for vertical adjustment of the orbit and the grinders which will now be described.

Grinder Adjustment

The blade B is maintained in sharpened condition by virtue of grinding stones S, S' seen in the central upper portion of FIG. 1. It will be appreciated that these stones must be repositioned in the event of either decrease in blade diameter or repositioning of the blade itself—as to the orbit O'. In the preferred practice of the invention, all of these activities occur concurrently. For example, when the blade becomes dull, it is sharpened and its diameter reduced necessitating lowering of the pivotal plate 15 to maintain the nadir below the bottom of the log. Optimally, the grinding stones S, S' are lowered to compensate for the blade wear and movement. The change in grinder stone position is initiated by a signal to solenoids 52, 53 (see FIG. 5). These, along with the associated mechanism for initiating change in position of the grinding stones S, S' are supported on the hub 19. More particularly, a housing 54 is rigidly secured to the hub 19 and carries the solenoids 52, 53. The solenoids are equipped with plungers 55, 56 which are connected to a cross bar 57. The cross bar 58, in turn, carries a rod 58 which extends through a bore in the housing 54. As the solenoids 52, 53 are energized, they retract the plungers 55, 56 and thereby move the rod 58 axially out of the housing 54, i.e., to an extended condition shown. This compresses the springs 59 which function when the solenoids are deactivated to return the cross bar 57 and hence the rod 58 to stand-by condition. The extension of the rod 58 results in the sequence of operations depicted in FIGS. 6–8.

Referring to FIG. 6, the numeral 21 again depicts the arm which is responsible for the orbiting of the blade B—by virtue of carrying the rotating shaft 23 (compare the left lower portion of FIG. 2). Rotatably mounted on the arm 21 is the starwheel 60 which has a tooth as at 61 orbiting along a path 62. The rod 18 when extended, interrupts this path and will cause rotation of the starwheel 60 and further mechanical activity ultimately resulting in the repositioning of the grinding stones S, S'.

The arm 21 and hence, the starwheel 60, rotate counterclockwise in the illustration given and about the coincident axis of the shafts 17 and 18. More particularly, the arm 21 is carried by the hub 19 and rotates therewith. The arm 21 also carries a dog 63 which is pivotally mounted on the arm 21. Both of these elements 60, 63 can be seen in the upper central portion of FIG. 2 as well.

As the arm 21 rotates counterclockwise, the underside of the dog 63 encounters the rod 58 and is pivoted to the position seen in FIG. 6. Continued rotation of the arm 21 brings the starwheel 60—more particularly the tooth 61—into engagement with the rod 58—as seen in FIG. 7. This engagement brings about a rotation of the starwheel 60 which is halted by engagement of the dog 63 with the starwheel 60 as seen in FIG. 8. This is brought about by the engagement of the dog 63 with the latching roller 64 carried by the hub 19—see also the central portion of FIG. 2.

Figure 9:
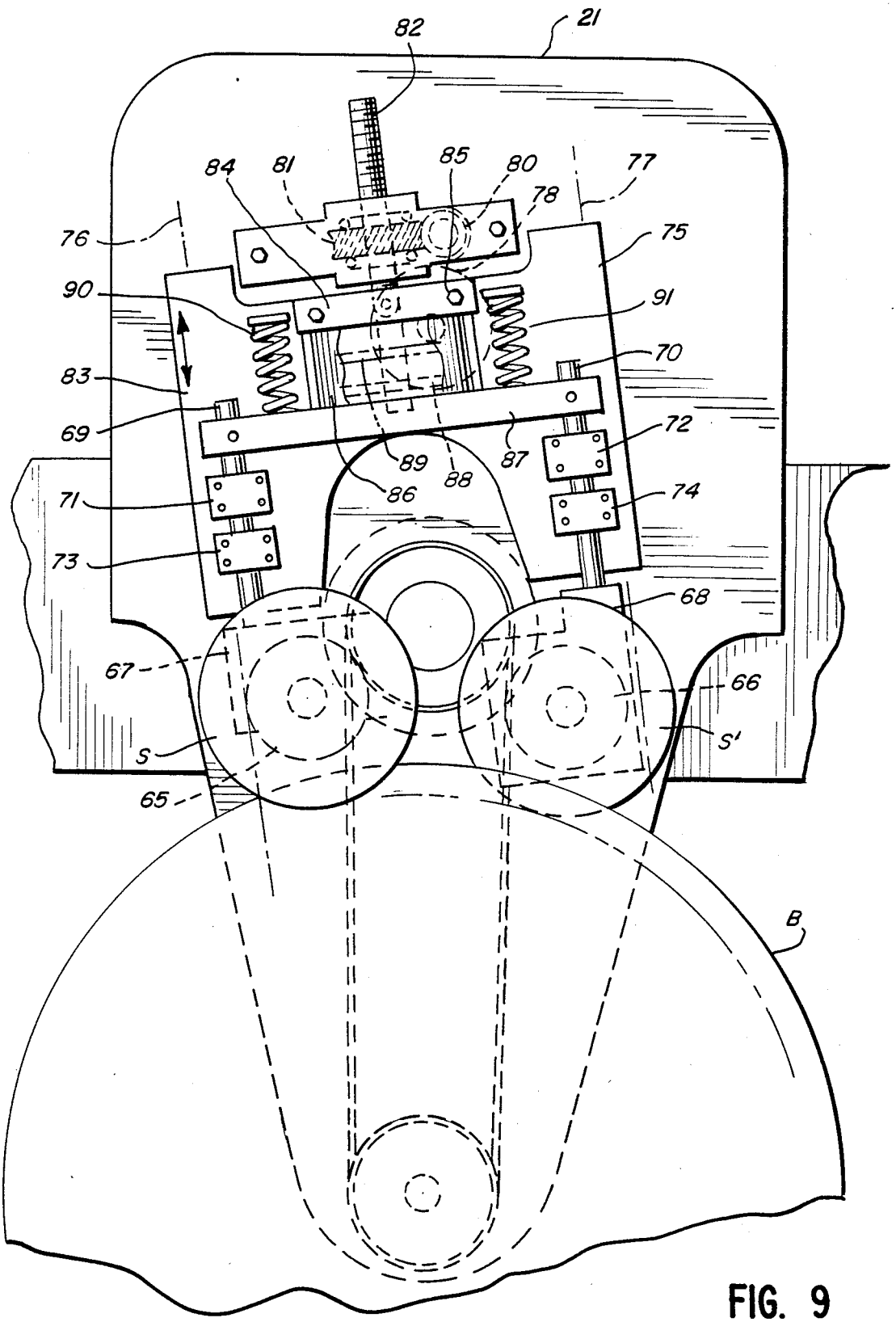
FIG. 9 is an end elevational view from the discharge end and showing details of further mechanism employed in grinder assembly adjustment and grinder actuation.

In the illustration given, the starwheel 60 on the orbiting arm 21 rotates 45° and this in turn sets in motion a gear train to reposition the grinder mounting assembly and move the grinder stones S, S' closer to the center of blade rotation and thus compensate for blade wear. FIG. 9 shows the balance of the components employed in the illustrated embodiment for adjusting the grinder assemblies downward toward the blade as wear occurs. As can be seen from FIG. 9, grinding stone S on one side of the blade and stone S' on the other side are mounted obliquely to give a proper bevel to the blade edge, and each are driven respectively by air motors 65 and 66, which in turn are supported on blocks 67 and 68. Shafts 69 and 70 move in parallel motion and are slidably disposed within linear bearing blocks 71–72 and 73–74. Bearing blocks 71–74 are fixed to slide plate 75 which slides on ways (not shown) aligned along axes 76 and 77.

In FIG. 2, the mechanism which actuates grinder stone adjustments includes the starwheel 60, spur gears 78, 79, and the co-acting helical gears 80 and 81. These latter parts are also shown at the top of FIG. 9. Rotation of the starwheel and its associated gear 78 (shown in phantom) ultimately result in rotation of helical gear 81 which is internally threaded to receive rod 82. Rotation of gear 81 therefore, results in movement of threaded rod 82 up or down as shown by arrow 83. The end of rod 82 is anchored in block 84 which is bolted as at 85 to slide plate 75. In effect, rotation of the starwheel and gear train effects movement of the threaded rod 82 and, by attachment, slide plate 75 and all other parts shown on the drawing, including air cylinder 86, pressure bar 87, slide rods 69, 70, the attached brackets 67–68, and the grinding stones S and S'. Rotation of gear 81, then, is effective in positioning the grinder assemblies closer to the center of blade rotation.

In FIG. 9, the stones are shown in the contacting or grinding position—note that the stones overlap the periphery of blade B. As air is applied to cylinder 86, the internal piston plate is positioned downwardly as well as the blocks 67, 68 and move the grinding stones downward into grinding contact with the blade. When the air cylinder 86 is inactive, the internal piston plate assumes a position as at 89—being returned to that position by action of springs 90, 91. The air cylinder stroke is approximately ¼", and this movement simply displaces the grinding stones from a non-grind and inactive position downwardly to the contact of grinding position. Being attached to slide plate 75 that is adjusted downwardly to compensate for blade wear, the ¼" movement for grinder actuation occurs regardless of the vertical position of the assembly.

Operation

In the operation of the invention which can be best first understood from a consideration of FIGS. 1 and 2, logs of convolutely wound paper are advanced along a conveyor 33 in index fashion, viz., 4½" or 9", 11" dependent upon whether toilet tissue or toweling is being produced. At the end of each index, the blade B rotates through an orbit O so as to effect a transverse severance in each of the logs being advanced on the conveyor 33.

The blade B (see FIGS. 1 and 2) is orbited by virtue of being eccentrically mounted on a rotating arm 21. The arm 21, in turn, is rotated by virtue of being attached to a hollow shaft 18 which is turned by a belt and pulley system 32, 31, 30, 29 and driven by motor 26 through drive 28.

The blade B is rotated itself by virtue of rotational power from motor 25 delivered through drive 26 to shaft 17. Shaft 17 through drive 24 rotates shaft 23 to which blade B is affixed.

When the blade becomes dull, sharpening is provided by the stones S, S'—see the central part of FIG. 1. These are moved into position by virtue of an air cylinder 86 (see FIG. 9).

The sharpening of the blade B necessarily results in a decrease in diameter which is also occasioned by the wear resulting from log sawing. This decrease in diameter requires a dual adjustment for optimum performance. The blade must be moved downwardly so that the nadir of its orbit is below the logs being sawed and the stones S, S' must also be moved downwardly so as to engage the blade for sharpening.

The downward movement of the orbit, as from O' to O in FIG. 3, is achieved by pivoting the plate 15 about the pivot 16 under the control of a screw lead 36. The screw lead 36 is incrementally turned by means of a motor 34 and engages a mechanism 37, 38 affixed to the plate 15. The turning of the screw lead 36 is monitored by sensing-control means 46 in the fashion depicted in FIG. 4. Additional sensing means to ascertain the proper position of the blade B is provided in the form of a sensor switch 51—see the central lower portion of FIG. 3.

Movement of the stones S, S' to proper position is achieved by the mechanism depicted in FIGS. 5–9. Fixed to the plate 15 (see FIG. 5) are solenoids which operate upon signal to extend rod 58. Rod 58 first unlatches a dog 63 carried by the orbit-providing arm 21—see FIG. 6. Thereafter, the rod 58 rotates the starwheel 60 also carried by the arm 21 to set in motion a gear train. The starwheel is rotated 45° after which time it is relatched by the dog 63 under the influence of a control cam roller 64—see FIG. 8.

The further mechanical action brought into play by the $\frac{1}{8}$ rotation of the starwheel 60 can be appreciated from a consideration of FIG. 9. The gear train which includes gears 78–81 is operative to turn the threaded rod 82 so as to move the slide plate 75 downwardly. Inasmuch as the stones S, S' are carried by the slide plate 75, this results in a proper repositioning of these stones.

Advantageously, each of the adjustments—of the plate 15 and the slide plate 75 is equal and in the illustrated embodiment are approximately 0.012".

It will be recognized that the concept of dual adjustment to compensate for blade wear can be applied to reciprocating saws, as well as orbiting saws, of single or two blade design. Different linkages and mechanical equivalents can be used depending upon the basic saw design.

While in the foregoing specification a detailed description of an embodiment of the invention has been set down for the purpose of illustration, many variations in the details hereingiven may be made by those skilled in the art without departing from the spirit and scope of the invention.

I claim:

1. In apparatus for transversely cutting logs of web material wherein logs are sequentially advanced along a first path and a rotating disc blade is mounted in said apparatus for movement in a second path through said first path from one side to the other of said first path to transversely sever said logs and sharpening means are provided in said apparatus for sharpening said blade, the improvement characterized by means in said apparatus for incrementally changing the relationship of said sharpening means and said blade to compensate for diameter reduction of said disc blade, said apparatus being equipped with means for altering the relationship of said paths to also compensate for diameter reduction of said blade, said second path being a circular orbit having its center above said first path, said incrementally altering means being adapted to maintain the nadir of said orbit below said first path, said incrementally altering means including means mounted on said apparatus below said first path for sensing the nadir of said orbit and delivering an actuating signal whenever said nadir is not below said first path.

2. The apparatus of claim 1 in which said apparatus is equipped with means for altering the relationship of said paths to also compensate for diameter reduction of said blade.

3. The apparatus of claim 2 in which said second path is a circular orbit having its center above said first path, said incrementally altering means being adapted to maintain the nadir of said orbit below said first path.

4. The apparatus of claim 3 in which said incrementally altering means includes means for sensing the nadir of said orbit and delivering an actuating signal whenever said nadir is not below said first path.

* * * * *